US006156377A

United States Patent [19]

Miyasaka

[11] Patent Number: 6,156,377

[45] Date of Patent: Dec. 5, 2000

[54] CERAMIC DISPERSION PLATING PROCESS

[75] Inventor: Yoshio Miyasaka, Aichi, Japan

[73] Assignee: Fuji Kihan Co., Ltd., Nagoya Aichi, Japan

[21] Appl. No.: 09/226,674

[22] Filed: Jan. 7, 1999

[30] Foreign Application Priority Data

Jan. 9, 1998 [JP] Japan ..... 10-003221

[51] Int. Cl.[7] ..... B05D 5/02; B05D 3/12

[52] U.S. Cl. ..... 427/205; 427/201; 427/203; 427/405; 427/426

[58] Field of Search ..... 427/11, 242, 201, 427/203, 205, 405, 426, 427, 454, 456, 184

[56] References Cited

U.S. PATENT DOCUMENTS

| | | | |
|---|---|---|---|
| 3,100,724 | 8/1963 | Rocheville . | |
| 3,632,368 | 1/1972 | Nelson . | |
| 3,697,389 | 10/1972 | Jacobs et al. . | |
| 3,754,976 | 8/1973 | Babecki et al. | 117/105 |
| 4,049,857 | 9/1977 | Hammer | 427/136 |
| 4,552,784 | 11/1985 | Chu et al. | 427/192 |
| 5,087,486 | 2/1992 | DeVos et al. | 427/264 |
| 5,302,414 | 4/1994 | Alkhimov et al. | 427/192 |
| 5,330,790 | 7/1994 | Calkins | 427/204 |
| 5,505,990 | 4/1996 | Sagawa et al. | 427/184 |
| B1 5,302,414 | 2/1997 | Alkhimov et al. | 427/192 |

FOREIGN PATENT DOCUMENTS

| | | |
|---|---|---|
| 1 521 359 | 7/1969 | Germany . |
| 30 03 045 A1 | 7/1981 | Germany . |
| 38 36 585 A1 | 5/1989 | Germany . |
| 62-278224 | 12/1987 | Japan . |
| 07137032 | 2/1995 | Japan . |

*Primary Examiner*—Shrive Beck
*Assistant Examiner*—Jennifer Kolb
*Attorney, Agent, or Firm*—Dennis G. LaPointe; Mason & Assoc., PA

[57] ABSTRACT

Provided is a low-priced metal coating treatment which causes less pollution, wherein the dispersion of ceramics and the forming of a metal coat are performed by blasting treatment; and a ceramic dispersion plating process making it possible to improve wear resistance, heat resistance and the like of a workpiece and the adhesion of the metal coat. When ceramic particles are ejected on the surface of a workpiece comprising a metal or a metal component by blasting, the workpiece is heated and softened so that the ceramic particles are dispersed inside the workpiece to form a dispersed layer. When a coating metal powder is further ejected thereon by blasting, the temperature of the dispersed layer rises in the same way so that elements in the composition of the coating metal powder diffuse and penetrate inside/on the surface of the dispersed layer to form a plating layer.

18 Claims, No Drawings

CERAMIC DISPERSION PLATING PROCESS

BACKGROUND OF THE INVENTION

1. Field of the Invention

The present invention relates to a metal coating treatment for strengthening the surface of a workpiece, improving the lubrication, wear resistance, heat resistance and anti-corrosion of the surface, decorating the surface, or the like, and more specifically to a ceramic dispersion plating process of dispersing ceramic particles into the surface of a workpiece and ejecting a metal powder to form a metal coat.

2. Description of Prior Art

Hitherto, there have been known hot-dip plating, electroplating, electroless plating, other vacuum evaporation, thermal spray and the like processes, as metal coating processes.

There has also known a composite plating process of incorporating ceramic particles (inorganic material particles) into a metal coat in order to make higher the strength, lubrication, wear resistance, heat resistance, adhesion or the like of the surface of a workpiece.

For example, the hot-dip plating process is a plating process of immersing a workpiece into a melted metal bath and subsequently raising the workpiece from the metal bath after a given time, and is carried out by using metals having a relatively low melting point. This process includes hot-dip zinc plating, hot-dip tin plating, hot-dip aluminum plating, hot-dip lead plating and the like.

The composite plating process is a manner of floating particles of alumina, silicic anhydride, silicon carbide or the like into a plating bath in an electroplating or electroless plating process and then embedding the particles into a metal deposited onto the cathode so as to incorporate/mix the particles into a resultant electroplating metal coat or electroless plating metal coat. This process is applied to a sliding member or the like.

The conventional metal coating treatments have the following problems.

(1) In, for example, the hot-dip plating process a liquid melted metal into which a workpiece of a solid metal is immersed is necessary. Therefore, costs of heating facilities are high for keeping the liquid metal constantly in a melted state.

There also arises a problem that the cost of this process is high since the rate of inferior products is high because of a lack of adhesion. For example, in the plating of an iron cast with chromium and the plating of an aluminum die casting product with melted nickel the inferior rate thereof is high because of a lack of adhesion. Thus, stable plating cannot be carried out.

(2) In the conventional metal coating treatments, harmful chemicals are used so that it is feared that pollution occurs, such as environment pollution caused by harmful vapor generated at the time of the metal coating treatment.

(3) In the composite plating, the costs of facilities are high, and additionally it is feared that pollution occurs for the same reason as in the aforementioned item (2).

Moreover, inorganic material particles are incorporated into a plating layer, and thus the plating layer becomes thick. Thus, exfoliation resistance strength is required and further post-processing becomes difficult.

In the case wherein the composite plating is applied to a sliding area, a companion member may be worn away by ceramic particles.

(4) When a plating layer is exfoliated in the conventional metal coating treatments, effects of the plating cannot be obtained.

The present invention has been made to solve the aforementioned problems, and thus it is an object to provide a low-priced metal coating treatment which causes less pollution by carrying out the dispersion of ceramics and the forming of a metal coat by blasting treatment, and provide a ceramic dispersion plating process wherein a lubrication face is formed on the surface of a workpiece so as to make it possible to improve its wear resistance, heat resistance and anti-corrosion, and decrease or overcome plating inferiority.

SUMMARY OF THE INVENTION

To attain the above-mentioned object, the ceramic dispersion plating process of the present invention, comprises the steps of ejecting ceramic particles onto a surface of a workpiece comprising a metal or a metal component by blasting, so as to disperse the ceramic particles into the workpiece; and subsequently ejecting a coating metal powder thereon by blasting, so as to cause elements in the composition of the coating metal powder to diffuse and penetrate inside/onto the surface of the workpiece comprising the metal or metal component.

The ceramic particles and the coating metal powder are preferably ejected at an ejection speed of 80 m/second or more, or at an ejection pressure of 0.3 MPa or more.

The ceramic particles have an average particle size of 10–100 $\mu$m and preferably, have a polygonal shape.

The coating metal powder has an average particle size of preferably 20–200 $\mu$m, and more preferably 20–100 $\mu$m, and may have any shape, but preferably has a substantially spherical shape, that is, a speroidal shape, or a polygonal shape.

Even if the coating metal powder has higher melting point and hardness than those of the workpiece, a metal coat can be formed.

The ceramic particles and the coating metal powder are particles made of one or more ceramics, and at least one powder made of a metal or metals, respectively. They may include fines particles having an average particle size of 80 $\mu$m or less; and ceramic particles having an average particle size of more than 80 $\mu$m, and 100 $\mu$m or less and a metal powder having an average particle size of more than 80 $\mu$m, and 200 $\mu$m or less.

DETAILED DESCRIPTION OF THE PREFERRED EMBODIMENTS

When ceramic particles are ejected at a high ejection speed onto the surface of a workpiece, thermal energy is generated by a change in speeds before and after the collision of the ceramic particles with the surface of the workpiece, considering the energy conservation law. This energy conversion arises at only deformed areas with which the ceramic particles collide. Therefore, a local rise in temperature occurs in the ceramic particles and in the vicinity of the surface of the workpiece.

The rise in the temperature is in proportion to the speed of the ceramic particles before the collision. Thus, the temperature of the ceramic particles and the surface of the workpiece can be raised if the ejection speed of the ceramic particles is made high. At this time, the surface of the workpiece is heated to be softened. Since the melting point of the ceramic particles is higher than that of metals, the ceramic particles are dispersed into the workpiece or bonded onto the workpiece.

Furthermore, the thermal conductivity of the surface of the workpiece in which the ceramic particles are dispersed becomes low. Therefore, when a coating metal powder is ejected at a high speed, a rise in temperature is liable to concentrate in the coating metal powder and the surface of the workpiece, on the basis of the energy conservation law. At this time, the coating metal powder is heated on the surface of the workpiece in the same manner as in the case of the ceramic dispersion. For this reason, elements in the coating metal powder are considered to be activation-adsorbed onto the surface of the workpiece to diffuse or penetrate. Thus, a metal coat is formed on/inside the surface of the workpiece.

In other words, it appears that the ceramic dispersing plating of the present invention is carried out by the two steps of ejecting the ceramic particles and the coating metal powder in sequence onto the workpiece.

Accordingly, the ceramic dispersion plating process of the present invention, which is different from various conventional plating processes, is a process of using dispersion and diffusion/penetration of the ceramic particles and the coating metal powder inside/onto the surface of the workpiece by the rise in temperature caused when the ceramic particles and the coating metal powder collide with the surface of the workpiece.

For more specific explanation, carburizing is given as an example to be reviewed. In the case wherein CO gas merely adheres physically to the surface of an iron-based metal product by a physical manner such as external force, heating or the like in such a manner that CO gas can easily be removed from the surface, Fe in the workpiece cannot react with CO. However, if heat or other energy is further given thereto at a certain level, CO gas is activation-adsorbed onto the surface of Fe. The activation-adsorbed CO gas is thermally dissociated into carbon dioxide and carbon. It has been thought that carbon resulting from this reaction diffuses into the lattice of Fe, so as to cause carburizing.

Considering the aforementioned conventional carburizing, it appears that, in the ceramic dispersing plating of the present invention, diffusion and penetration as described hereinafter arise in a metal product. Since the melting point of the ceramic particles is higher than metals, the ceramic particles are dispersed into the workpiece or bonded onto the workpiece.

For example, when ceramic particles B are ejected at an election speed of 80 m/sec or more or at an ejection pressure of 0.3 MPa or more on the surface of a metal workpiece A so that the ceramic particles B are caused to collide with the surface of the metal workpiece A, the ceramic particles rebound. However, the speed of the ceramic particles B becomes smaller after the collision. That is, as described above, their kinetic energy is reduced after the collision, and then a part of the reduced energy is converted into sound and most of the reduced energy is converted into thermal energy, on the basis of the energy conservation law. The thermal energy can be considered as internal friction caused by the deformation of the collision region of the metal workpiece at the time of the collision. The thermal conversion is carried out at only the deformed region with which the ceramic particles collide, so that the temperature of the workpiece rises locally. It appears that at this time the surface of the metal workpiece is heated and softened so that the ceramic particles are dispersed into the workpiece. It also appears that, next, a coating metal powder is ejected so that the coating metal powder is heated in the same manner as in the case of the ceramic particles and then diffuses and penetrates inside/onto the ceramic dispersed layer on the surface of the workpiece.

When the ceramic particles are dispersed inside/onto the surface of the workpiece, the heat resistance and wear resistance of the surface of the workpiece are improved. The metal coat is further formed on the surface of the ceramic dispersed layer, so that lubrication is also gained. At this time, however, the thermal conductivity of the workpiece is reduced by the ceramic particle dispersed layer. Thus, the temperature of the coating metal powder is liable to rise on the surface of the workpiece, so that the coating metal powder easily diffuses and penetrates.

Conventionally, in order to form a metal coat on the surface of a workpiece by blasting treatment, it is necessary that the hardness or the melting point of a coating metal powder is lower than that of the workpiece. However, ceramic dispersion according to the present invention makes it possible to realize coating of a metal having a higher hardness or melting point than that of the workpiece.

EMBODIMENTS

Examples of the present invention will be described hereinafter:

Blast Machine

A blast machine used in this example is a gravity blast machine, but any other air type blast machines may be used, wherein ejection energy of a compressed gas is used to blow an abrasive. Examples thereof are a siphon or suction blast machine, which is in an absorption type, and a straight hydraulic blast machine.

In the straight hydraulic blast machine, in a recollecting tank of an abrasive, which is herein a powder, the abrasive after ejection and dust are separated, and the dust is fed through a duct to a dust collector having an exhauster, and the abrasive drops down to the lower portion of the recollecting tank so that the abrasive is collected at this portion. A pressure tank is disposed, through a dump valve, under the recollecting tank. When the abrasive is removed away from the pressure tank, the dump valve goes down so that the powdery abrasive in the recollecting tank is introduced into the pressure tank. When the powder is introduced into the pressure tank, a compressed gas is charged into this tank. Simultaneously, the dump valve is closed so that the pressure in the pressure tank rises. Thus, the powder is forced out from a supplying opening at the lower position of the tank. To the supplying opening, a compressed gas as a reactive ejecting gas is separately introduced, and the powder is carried to a nozzle by a hose. The powder is then ejected together with the gas at a high speed from its nozzle tip.

The outline of the suction blast machine will be described in brief. When a compressed gas is ejected from a hose connected to a source for supplying the compressed gas as a reactive ejecting gas into an ejection nozzle for suction, the inside of the nozzle is made into a negative pressure. This negative pressure causes a powder inside a tank to be sucked into the nozzle through an abrasive hose, and then the powder is ejected from its nozzle tip.

A gravity blast machine used in the Examples will be described.

In the gravity blast machine, which is specifically a suction blast machine herein, a nozzle for ejecting an abrasive such as a shot is disposed inside a cabinet having a gateway for taking in and out a workpiece. This nozzle is connected to a pipe. This pipe is connected to a compressor. A compressed gas is supplied from this compressor. A hopper is arranged under the cabinet. The lowest end of the hopper is connected through a conduit to an upper side face of a recollecting tank arranged above the cabinet, and the lower end of the recollecting tank is connected through a pipe to the nozzle. The abrasive in the recollecting tank is subjected to gravity or a given pressure so as to drop from the recollecting tank. The abrasive is then supplied through the pipe to the nozzle under a negative pressure, so that the abrasive is ejected, together with the compressed gas.

The ejected abrasive, and dust produced at this time drop into the hopper below the cabinet, and then rise by a rising air current which is being generated in the conduit so that they are forwarded to the recollecting tank. Thus, the abrasive is recollected. The dust inside the recollecting tank is introduced from the upper end of the recollecting tank through the pipe to the dust collector by means of an air current inside the recollecting tank, and then is collected at the bottom of the dust collector. Normal gas is discharged from the exhauster arranged at the upper portion of the duct collector.

EXAMPLE 1

Using the aforementioned blast machine, an aluminum die casing product, which was a workpiece, was arranged from its gateway inside the cabinet. An abrasive was ejected from the nozzle to the surface of the workpiece under the working condition shown in Table 1, so as to carry out blasting.

TABLE 1

Example 1
Workpiece: Aluminum die casting product (piston)

| | Ceramic dispersion | Metal coating |
|---|---|---|
| Blast machine | gravity | gravity |
| Particle and powder materials | silicon carbide (SiC) | tin (Sn) |
| Average particle size (μm) | 37 | 44 |
| Particle shape | polygon | substantial sphere |
| Ejection pressure (MPa) | 0.4 | 0.5 |
| Nozzle diameter (mm) | 8 | 8 |
| Ejection distance | 100 | 100 |
| Ejection time/piece (second) | 30 | 60 |

When ceramic dispersion was first carried out by the aforementioned treatment, silicon carbide was dispersed into the region over a depth of 10 μm from the surface of the workpiece at a size of from 1/20 to 1/10 of the particle size before the ejection, so as to form a dispersed layer. Furthermore, tin powder was ejected on the surface of this dispersed layer, so as to form a tin plating layer of 2–3 μm depth from the surface.

This workpiece had a life span 2 or more times that of conventional pistons, and the piston head of the workpiece had improved heat resistance.

EXAMPLE 2

Next, ceramic dispersion plating was carried out under the condition shown in Table 2.

Example 2
Workpiece: Iron sintered metal-product (Rotor of an oil-hydraulic pump)

| | Ceramic dispersion | Metal coating |
|---|---|---|
| Blast machine | gravity | straight hydraulic |
| Particle and powder materials | silicon carbide (SiC) | nickel |
| Average particle size (μm) | 37 | 47 |
| Particle shape | polygon | substantial sphere |
| Ejection pressure (MPa) | 0.4 | 0.4 |

-continued

Example 2
Workpiece: Iron sintered metal-product (Rotor of an oil-hydraulic pump)

| | Ceramic dispersion | Metal coating |
|---|---|---|
| Nozzle diameter (mm) | 8 | 5 |
| Ejection distance | 150 | 200 |
| Ejection time/piece (second) | 20 | 40 |

When ceramic dispersion was first carried out by the aforementioned treatment, silicon carbide was dispersed into the region over a depth of 5 μm from the surface of the workpiece at a size of from 1/25 to 1/15 of the particle size before the ejection, so as to form a dispersed layer of silicon carbide (SiC). Furthermore, nickel powder was ejected on the surface of this dispersed layer, so as to form a nickel plating layer of 1–2 μm depth from the surface.

This workpiece had a life span 2 or more times that of conventional rotors, and the effect of preventing seizure was obtained.

EXAMPLE 3

Next, ceramic dispersion plating was carried out under the condition shown in Table 3.

Example 3
Workpiece: Copper alloy casting mold

| | Ceramic dispersion | Metal Coating |
|---|---|---|
| Blast machine | gravity | straight hydraulic |
| Particle and powder materials | $Al_2O_3$ | nickel |
| Average particle size (μm) | 53 | 47 |
| Particle shape | polygon | substantial sphere |
| Ejection pressure (MPa) | 0.4 | 0.5 |
| Nozzle diameter (mm) | 8 | 5 |
| Ejection distance | 150 | 20 |
| Ejection time/piece (second) | 5 | 5 |

When ceramic dispersion was first carried out by the aforementioned treatment, $Al_1O_3$ was dispersed at a size of from 1/20 to 1/10 of the particle size before the ejection, so as to form a dispersed layer of 5–6 μm depth from the surface. Furthermore, nickel powder was ejected on the surface of the dispersed layer, so as to form a nickel plating layer of 1–2 μm depth from the surface.

Conventionally, copper alloy molds were subjected to electroless nickel plating. However, there was a problem that their life span was short. In Example 3, the copper alloy mold was subjected to the surface treatment and subsequent electroless nickel plating so as to be used. As a result, the adhesion strength of the nickel plating was improved, so that the present mold had a life span 2 or more times that of conventional molds and had improved heat resistance.

The present invention has the structure as described above, and thus exhibits advantages which will be described in the following.

(1) Metal coating treatment is carried out by a blast machine, so that costs can be reduced.

(2) Pollution is reduced. Conventional metal coating treatments have a problem that harmful chemicals are used and environmental pollution arises by harmful vapor which is generated at the time of the metal coating treatment.

(3) The heat resistance, wear resistance and surface strength of a workpiece can be improved by ceramic dispersion.

Moreover, a metal having higher hardness and melting point than those of the workpiece can be applied as a coat by blasting, and further adhesion of the coat layer is high by the dispersion of the ceramic particles into the workpiece. Thus, the coat layer may be thin, and the yield rate of materials is also good.

(4) In the conventional process of incorporating ceramic particles at the time of melting a base metal, post-processing is difficult. Additionally, in a sliding area, a companion thereof, i.e., a metal surface on which the sliding area is slid is worn off. In the present invention, however, lubrication is given to the surface of the workpiece, so that such wear as above can be prevented.

(5) Even if the metal coat is exfoliated, the ceramic dispersed layer remains. Therefore, the life span is prolonged.

What is claimed is:

1. A ceramic plating process, comprising the steps of:

ejecting ceramic particles onto a surface of a workpiece comprising a metal or a metal component by blasting, the ejection of the ceramic particles by blasting for generating a local rise in temperature in the workpiece such that the ceramic particles are dispersed into the workpiece and for reducing a thermal conductivity of the surface of the workpiece; and subsequently ejecting a coating consisting essentially of a metal powder thereon by blasting, wherein when the coating metal powder is ejected on the workpiece with said reduced thermal conductivity, a resultant increase in temperature is concentrated on the coating metal powder and the surface of the workpiece, so as to cause elements in the composition of the coating metal powder to diffuse and penetrate inside/onto a ceramic particle dispersed layer on the surface of the workpiece previously treated with ceramic particles by blasting.

2. The ceramic dispersion plating process according to claim 1, wherein the ceramic particles and the coating metal powder are ejected at an ejection speed of 80 m/second or more, or at an ejection pressure of 0.3 MPa or more.

3. The ceramic dispersion plating process according to claim 1, wherein the ceramic particles have an average particle size of 10–100 $\mu$m.

4. The ceramic dispersion plating process according to claim 1, wherein the ceramic particles have a polygonal shape.

5. The ceramic dispersion plating process according to claim 1, wherein the coating metal powder has an average particle size of 20–200 $\mu$m.

6. The ceramic dispersion plating process according to claim 1, wherein the coating metal powder has a spheroidal shape.

7. The ceramic dispersion plating process according to claim 1, wherein the coating metal powder has higher melting point and hardness than those of the workpiece.

8. The ceramic dispersion plating process according to claim 1, wherein the ceramic particles have a polygonal shape and the coating metal powder has a spheroidal shape.

9. A ceramic dispersion plating process, comprising the steps of:

ejecting ceramic particles having an average size of 10–100 $\mu$m onto a surface of a workpiece comprising a metal or a metal component by blasting, the ejection of the ceramic particles by blasting for generating a local rise in temperature in the workpiece such that the ceramic particles are dispersed into the workpiece and for reducing a thermal conductivity of the surface of the workpiece; and subsequently ejecting a coating consisting essentially of a metal powder having an average particle size of 20–200 $\mu$m thereon by blasting, wherein when the coating metal powder is ejected on the workpiece with said reduced thermal conductivity, a resultant increase in temperature is concentrated on the coating metal powder and the surface of the workpiece, so as to cause elements in the composition of the coating metal powder to diffuse and penetrate inside/onto a ceramic particle dispersed layer on the surface of the workpiece previously treated with ceramic particles by blasting.

10. The ceramic dispersion plating process according to claim 1, wherein the ceramic particles are blasted by a gravity blast machine and the coating metal powder is blasted by a straight hydraulic blast machine.

11. The ceramic dispersion plating process according to claim 1, wherein the ceramic particles are silicon carbide and the coating metal powder is tin.

12. The ceramic dispersion plating process according to claim 1, wherein the ceramic particles are silicon carbide and the coating metal powder is nickel.

13. The ceramic dispersion plating process according to claim 9, wherein the ceramic particles have a polygonal shape and the coating metal powder has a spheroidal shape.

14. The ceramic dispersion plating process according to claim 9, wherein the ceramic particles are blasted by a gravity blast machine and the coating metal powder is blasted by a straight hydraulic blast machine.

15. The ceramic dispersion plating process according to claim 9, wherein the ceramic particles are silicon carbide and the coating metal powder is tin.

16. The ceramic dispersion plating process according to claim 9, wherein the ceramic particles are silicon carbide and the coating metal powder is nickel.

17. The ceramic dispersion plating process according to claim 1, wherein the coating metal powder has an average particle size of 20–100 $\mu$m.

18. The ceramic dispersion plating process according to claim 1, wherein the coating metal powder has a polygonal shape.

* * * * *